US006709059B1

(12) United States Patent
Cvek

(10) Patent No.: US 6,709,059 B1
(45) Date of Patent: Mar. 23, 2004

(54) ADJUSTABLE NON-BIASED POSITIONING MECHANISM

(76) Inventor: Sava Cvek, 40 Woodland Rd., Boston, MA (US) 02130-3018

( * ) Notice: Subject to any disclaimer, the term of this patent is extended or adjusted under 35 U.S.C. 154(b) by 0 days.

(21) Appl. No.: 09/626,973

(22) Filed: Jul. 27, 2000

(51) Int. Cl.[7] ..... B60N 2/02
(52) U.S. Cl. ..... 297/353
(58) Field of Search ..... 297/353, 383, 297/411.36, 411.37, 410, 406; 248/407, 423, 429

(56) References Cited

U.S. PATENT DOCUMENTS 4,639,039 A 1/1987 Donovan ..... 297/353
4,887,866 A 12/1989 Rusin ..... 297/421
4,951,995 A 8/1990 Teppo et al. ..... 297/411
4,968,094 A 11/1990 Froyland et al. ..... 297/411
5,213,395 A 5/1993 Korteweg et al. ..... 297/328
5,462,338 A * 10/1995 Baumann
5,695,249 A * 12/1997 Lotfi
5,839,786 A 11/1998 Cvek ..... 297/411.35

* cited by examiner

*Primary Examiner*—Milton Nelson, Jr.
(74) *Attorney, Agent, or Firm*—O'Connell Law Firm

(57) ABSTRACT

A positioning mechanism is provided that does not require a biasing member to allow adjustment and maintenance of a position. A first member is provided with a channel forming locking positions and a return channel. A second member, slidably movable with respect to the first member, is provided to mount a rotatable cog. The cog interfaces with the channel of the first member to selectively inhibit relative movement between the first and second members without use of a biasing member.

23 Claims, 6 Drawing Sheets

ADJUSTABLE NON-BIASED POSITIONING MECHANISM

BACKGROUND OF THE INVENTION

A wide variety of applications call for the ability to adjust and maintain the position of two objects relative to each other. Ease of adjustment and ability to hold a position once set are desirable. Additional desirable characteristics of a positioning device include high reliability, compact size and ease of manufacture.

Known positioning and adjustment devices have typically involved the use of a biasing means, such as a spring to control positioning. Springs often increase the effort required to adjust position of objects, because invariably, the operator is working against the spring, often multiple times, during adjustment. Springs are troublesome in that they are prone to wearing out or breaking. Spring failures can result in catastrophic failure of the entire positioning means. Assembly of a positioning device involving a spring can also be problematic and dangerous due to the high forces typically required to compress a spring during assembly of the positioning device.

One application of positioning devices involves furniture, and more specifically, chairs. Adjustment of chair components has long been known to increase comfort and efficiency of workers seated for long periods. A variety of adjustment devices have been used to allow for adjustment of chair components, such as seats, backrests and armrests. However, these devices have typically suffered from the drawbacks involved with reliance on a biasing means.

Similarly, adjustment of machines to adapt to different worker sizes is desirable to increase worker comfort and efficiency. Such applications are also typically disadvantaged by the use of a biasing means.

A need exists for a positioning device that does not involve a biasing means, thereby providing increased usability, reliability and efficiency in manufacture.

SUMMARY OF THE INVENTION

According to one embodiment of the invention, a positioning mechanism is provided, having a first member defining a channel, a second member, slidably mounted to the first member along an axis, a substantially non-biased cog, rotatably mounted to the second member, such that the channel and the cog interact to inhibit motion of the second member in a first direction relative to the first member until the second member has traveled substantially in a second direction.

A further, optional aspect of the invention includes a positioning mechanism involving an entry channel, continuous with the channel, to permit entry of the cog into the channel by slidable movement between the first and second members along the axis.

According to a second embodiment of the invention, an adjustment mechanism is providing, having a first member defining a channel, a second member mounted to the first member to be slidable with respect to the first member along an axis, a cog, substantially free of a biasing member and mounted between the first and second members and adapted to rotate with respect to the second member, such that the channel is formed to create locking positions, enabling the cog to inhibit motion of the second member in a first direction relative to the first member.

An optional aspect of the second embodiment of the invention is an undulating surface formed in a side of one of the first and second members, facing an other of the first and second members and oriented parallel to the axis, and a tab, mounted to the other of the first and second members and biased toward the one of the first and second members, adapted to travel along the undulating surface.

BRIEF DESCRIPTION OF THE DRAWINGS

These and other features and advantages of the present invention will be more fully understood by reference to the following detailed description in conjunction with the attached drawings in which like reference numerals refer to like elements through the different views. The drawings illustrate principles of the invention and, although not to scale, show relative dimensions.

DETAILED DESCRIPTION OF INVENTION

The invention is useful in a variety of applications involving adjustment or positioning of two items relative to each other. In the workplace, a variety of items can be configured for use by a wide variety of workers or tasks. For example, in a factory, worktables or manufacturing equipment can often be adjusted for height, thereby accommodating different optimal operating heights among workers. Other applications involve adjustment of equipment for varying workpiece sizes. Processing guides and safety guards are examples of objects that may require repositioning frequently. A common application involving positioning of objects involves positioning of furniture components, such as the seat, backrest and armrests of a chair. Although not limited to adjustment of chair component position, the invention will now be described in relation to use in a chair.

Figure 1:
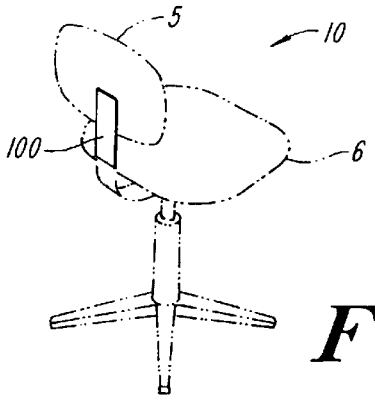
FIG. 1 is a perspective view of a chair incorporating a positioning mechanism of the present invention.

One application of the invention is directed to use with a chair backrest 5 and is shown in FIG. 1. A positioning mechanism 100 is located between the chair backrest 5 and a chair seat 6. The positioning mechanism 100 allows the chair backrest 5 to be located at different heights relative to chair seat 6, thereby allowing a person sitting in the chair to locate the chair backrest 5 in an ideal position.

Figure 2:
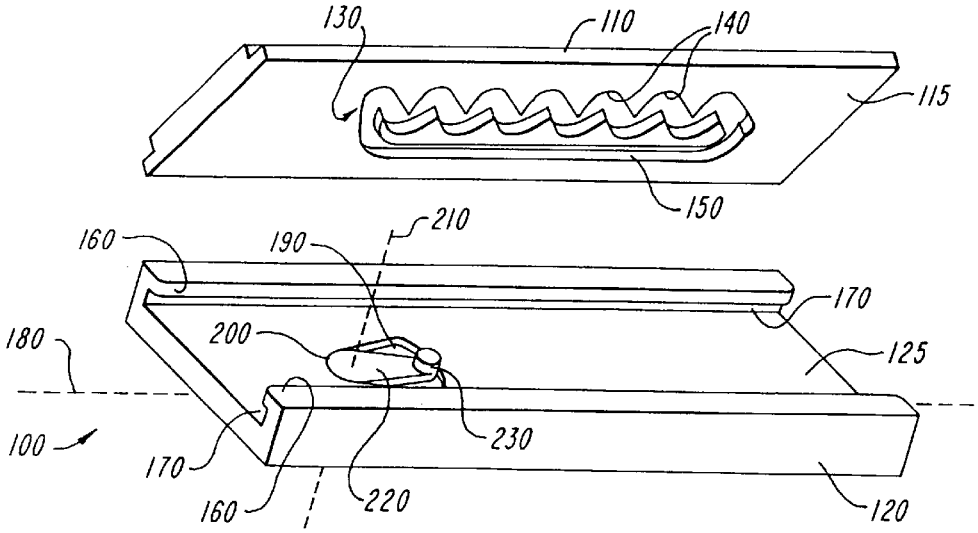
FIG. 2 is a exploded view of a positioning mechanism according to an embodiment of the invention.

FIG. 2 provides an exploded view of one embodiment of the invention. A positioning mechanism 100 includes a first member 110 and a second member 120. The first member is preferably formed with a first substantially planar surface 115. A channel 130 is formed in first member 110, preferably in the first substantially planar surface 115 of first member 110. The channel 130 is preferably formed in a loop including locking positions 140 along one side of the loop and a return channel 150 formed along an opposing side of the loop.

Second member 120 is preferably formed with a second substantially planar surface 125 for sliding engagement with the first substantially planar surface 115 of first member 110.

First and second members 110, 120 are not required to have a substantially planar surface. However, first and second members 110, 120 are to be configured to allow for movement in relation to each other.

Second member 120 is preferably provided with at least one flange 160 forming a guide groove 170 in which edges of side member 110 can be accommodated. Flanges 160 and guide groove 170 are preferably configured to ensure that first member 110 slides linearly with respect to second member 120 along an axis 180. As one example of an alternative embodiment, the direction of travel of first and second members 110, 120 may be guided by the movement of objects to which each of the first and second members 110, 120 are mounted. In such an embodiment, grooves or flanges may be omitted from the first and second members 110, 120.

Another variation of first and second members 110, 120 involves integrally forming one or both of first and second member 110, 120 as part of a component to which they would otherwise be mounted. Such a configuration is often more efficient to manufacture. For example, first and second member 110, 120 may each be integrally formed into a chair backrest 5, chair seat 6.

As shown in FIG. 2, second member 120 is preferably formed with a receptacle 190 beginning at and extending below the substantially planar surface 125. The receptacle 190 is preferably formed in the shape of an arc extending from a recessed portion 200 of receptacle 190. In a preferred embodiment of the invention, the arc extends 53°.

The recessed portion 200 of receptacle 190 is formed to provide an axis of rotation 210 within receptacle 190.

First and second members 110, 120 may be made of a wide variety of plastics or metals. In a preferred embodiment of the invention, first and second members 110, 120 are constructed of a nylon, such as Kisso. One of skill in the art will appreciate that many manufacturing processes are available for creating first and second members 110, 120, such as, by way of example, injection molding, casting or machining.

A cog 220 is located within receptacle 190 and formed to rotate about the axis of rotation 210. The cog is also formed to interface with channel 130 of first member 110, preferably with a cog tooth 230. The cog 220 is preferably mounted to second member 120 by placing the cog 220 within receptacle 190. If cog 220 is formed with a protrusion 225, shown in FIG. 3B, the protrusion 225 preferably rotatably mates with recessed portion 200 of receptacle 190. In a preferred embodiment of the invention, the cog tooth 230 has a circular cross-section and a width of channel 130 is approximately equal to the diameter of the circular cross-section of cog tooth 230.

Figure 3A:
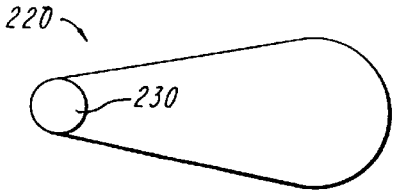
FIG. 3A is a top view of a cog according an embodiment of the invention.
Figure 3B:
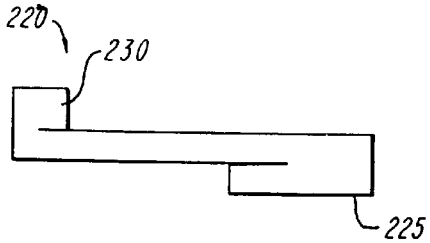
FIG. 3B is a side view of the cog shown in FIG. 5A.

FIGS. 3A and 3B provide views of a preferred cog 220 configuration. The cog 220 may be made of a wide variety of plastics or metals. A preferred configuration involves a cog made metal, such as aluminum. One of skill in the art will appreciate that many manufacturing processes are available for creating cog 220, such as, by way of example, injection molding, casting or machining.

First member 110 and second member 120 are designed to be slidably mounted to each other, preferably accommodating linear relative movement along axis 180. During relative motion between first member 110 and second member 120, cog 220 rotates along axis of rotation 210 so that a portion of cog 220, extending above substantially planar surface 125, travels within channel 130 of first member 110.

Figure 4:
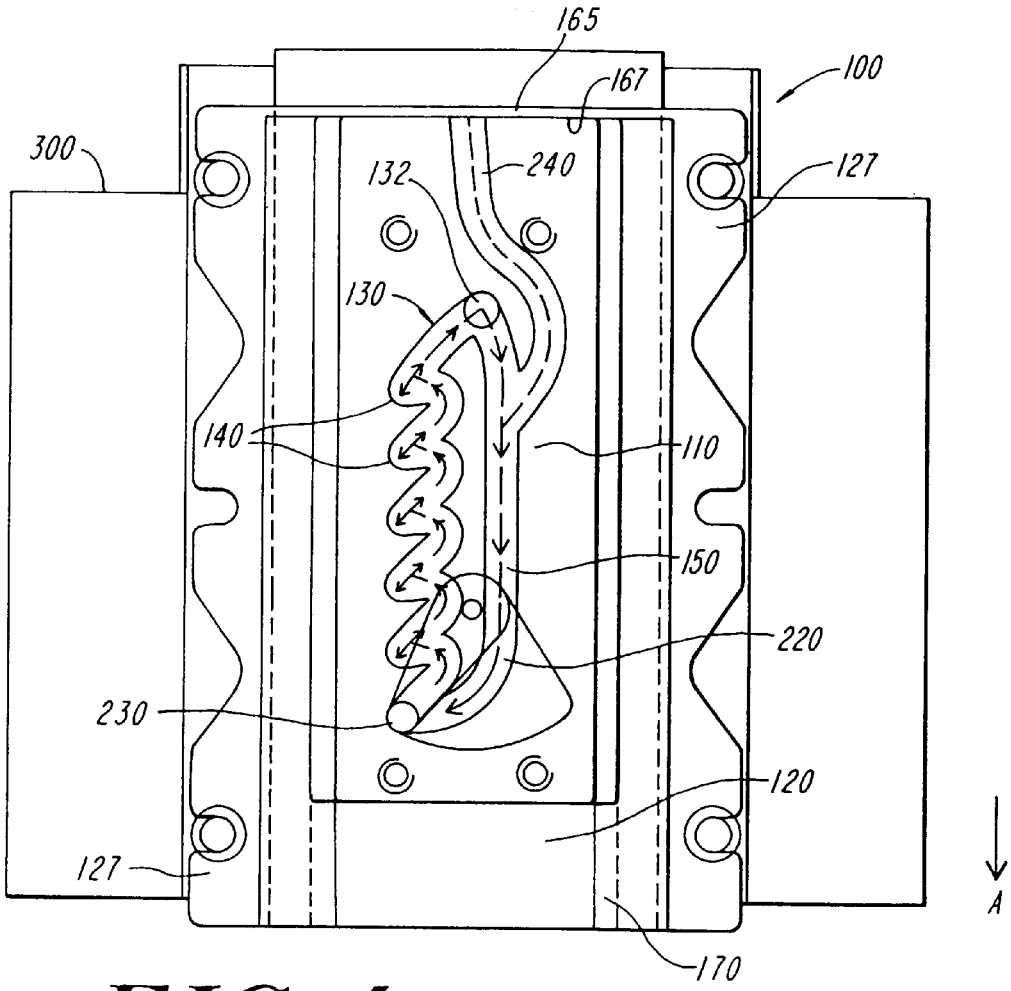
FIG. 4 is a cut-away side view illustrating a positioning member according to an embodiment of the invention.

As shown in FIG. 4, channel 130 is configured so that a portion of cog 220, such as, for example as described herein, cog tooth 230, can travel into locking positions 140 or past locking positions 140, depending on the direction of relative motion between first and second members 110, 120.

Channel 130 is formed to rotate the cog 220 toward each locking position 140. Because channel 130 and locking positions 140 work together to guide the rotating of cog 220, a biasing device is not required to bias the cog 220 toward the locking positions 140. 10 Locking positions 140 are shaped to catch and hold a portion of cog 220, preferably cog tooth 230, by rotating cog 220 toward the locking positions 140 during relative motion between first and second members 110, 120 in a particular direction. Conversely, channel 130 is formed to inhibit engagement of cog tooth 230 in locking positions 140 during relative motion between first and second members 110, 120 in an opposite direction.

For example, as shown in FIG. 4, if first member 110, in which channel 130 is formed, travels in direction A relative to second member 120, to which cog 220 is rotatably mounted, the cog tooth 230 travels along channel 130 without engaging in locking positions 140.

Relative movement between first and second members, 110, 120 in a direction opposite to direction A is inhibited by the shape of locking positions 140. In the event first member 110 stops traveling in direction A, relative to second member 120, and begins traveling opposite to direction A when cog tooth 230 is in channel 130 near locking positions 140, the cog tooth 230 will enter a locking position 140, preventing further relative movement opposite to direction A between first and second members 110, 120. To continue further relative movement between first and second members 110, 120 opposite to direction A, first member 110 travels to a maximum limit in direction A, thereby positioning cog tooth 230 in reset position 132.

Reset position 132 is positioned relative to axis of rotation 210 such that relative movement of first member 110 opposite to direction A results in cog 220 rotating to position cog tooth 230 into return channel 150, preventing cog 220 from engaging locking positions 140. First member 110 is then free to travel to a maximum limit of travel in a direction relative to second member 120, opposite to direction A.

In a variation of the invention, the orientation of the locking positions 140 and return channel 150 may be reversed about a vertical axis as shown in FIG. 4. For example, locking positions 140 may be formed on the right and return channel 150 formed on the left.

In an optional embodiment, an end limit 165 is formed in guide groove 170 or first or second members 110, 120 to limit travel of first member 110 in a maximum limit of travel in a direction relative to second member 120, opposite to direction A. Such an embodiment absorbs impact forces as a maximum limit of travel is reached, thereby reducing strain on cog 220. Typical examples of such an application include a chair backrest 5 being raised to an upper limit of travel and released to travel to a bottom limit of travel. An end limit 165 can be provided to absorb the impact of stopping the downward travel of the chair backrest 5. As a further option, a dampening surface 167 can be provided on the end limit 165 at a location where the end limit 165 meets the first member 110, in the case of the end limit 165 formed in or mounted to the second member 120. The dampening surface can include a variety of impact-absorbing material, such as one or more rubber dowels or felt or various polymers.

An entry channel 240 is preferably provided to allow cog 220 to enter into channel 130 upon initial assembly. Entry channel 240 allows cog 220 to enter channel 130 by way of linear motion between first member 110 and second member 120. Entry channel 240 joins channel 130 at an angle inhibiting cog 220 from re-entering entry channel 240 once cog 220 is within channel 130.

FIG. 4 also illustrates an optional configuration allowing the second member 120 to be mounted to object 300. An attachment device 310, such as, for example, a bolt, screw or rivet, may be provided to secure either the first or second member 110, 120 of the invention to object 300. A variety of attachment devices will be apparent to one of skill in the art for use with the invention. For example, object 300 may be configured with tabs to secure one end of either the first or second member 110, 120 of the invention and another attachment device employed to secure an opposite end of either the first or second member 110, 120 to object 300.

Figure 5:
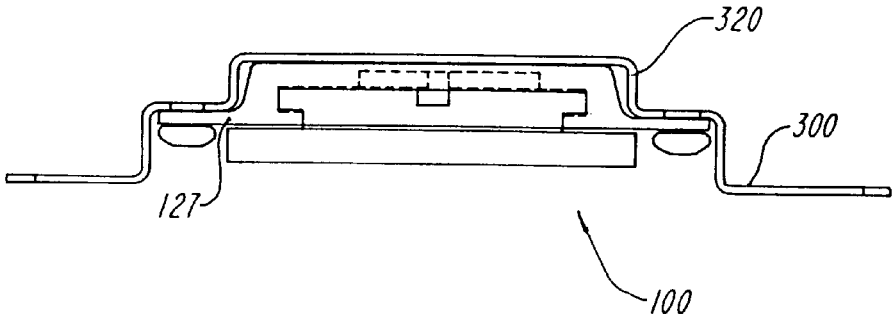
FIG. 5 is an end view of the positioning mechanism shown in FIG. 3.

FIG. 5 provides an end view showing flanges 160 and guide grooves 170 of second member 120 located around edges of first member 110. Receptacle 190 and axis of rotation 210 are also illustrated in FIG. 5. Object 300 is also shown having an indented volume 320 to accommodate first and/or second members 110, 120. A mounting flange 127 is provided for mating with object 300. Mounting flange 127 may also be formed so that object 300 does not need to have an indented volume 320.

Figure 6:
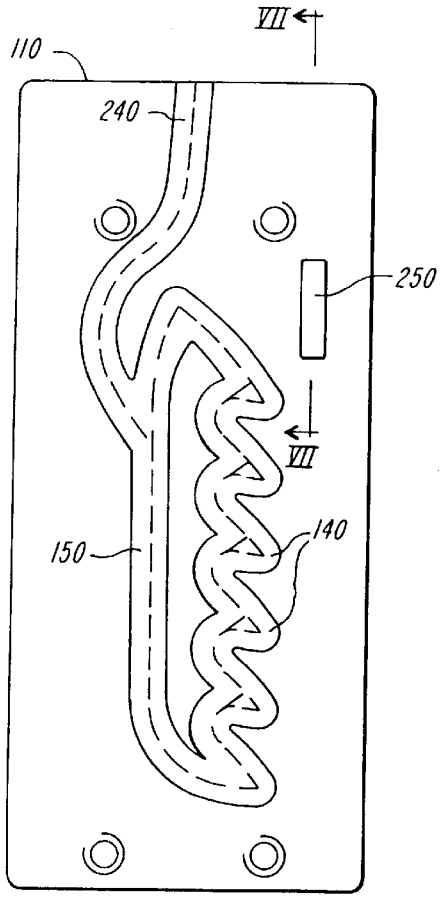
FIG. 6 is a top view of a first member of a preferred embodiment of a positioning member according to the invention.
Figure 7:
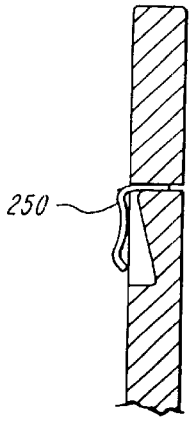
FIG. 7 is a cross-sectional view of a tab mounted to the first member shown in FIG. 6.
Figure 8:
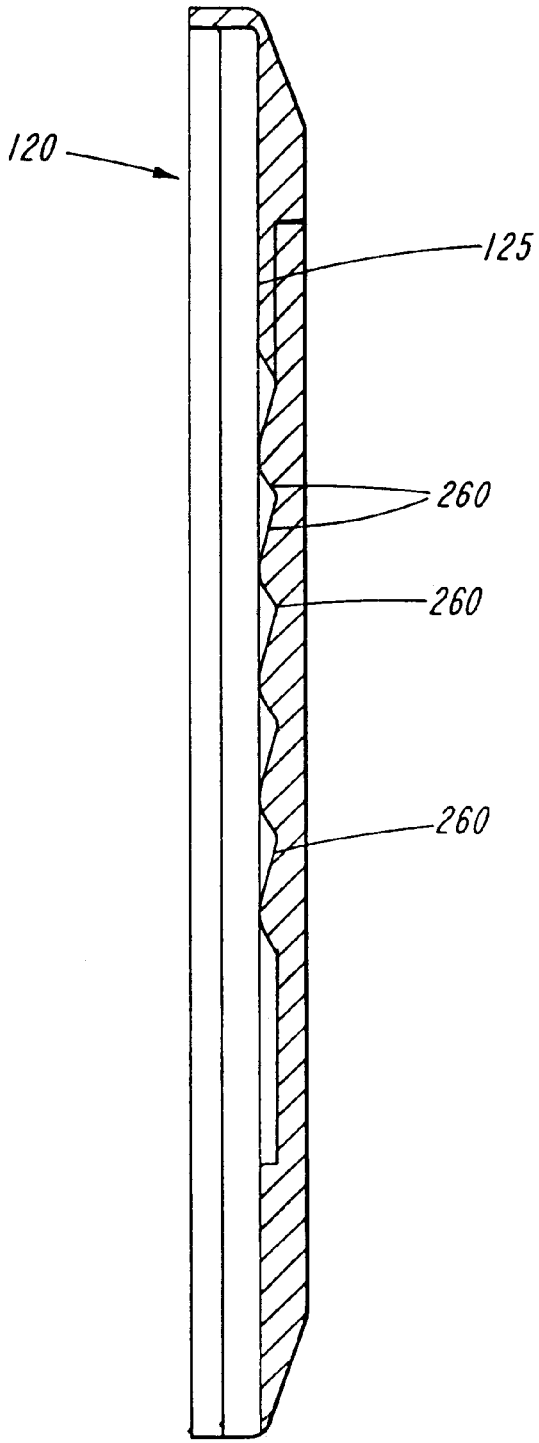
FIG. 8 is a cross-sectional view of an undulating surface formed in a second member.

According to a preferred embodiment of the invention, as shown in FIGS. 6 and 7, a tab 250 may be provided on substantially planar surface 125 of second member 120 or a substantially planar surface 115 of first member 110. A corresponding undulating surface 260, shown FIG. 8, may be provided on the opposing substantially planar surface of substantially planar surface 125 of second member 120 and or substantially planar surface 115 of first member 110. Tab 250 and undulating surface 260 are configured to interface with each other and provide feedback to a user during operation of positioning mechanism 100. Feedback may include sound, such as a clicking sound during motion between first member 110 and second member 120. Clicking sounds may preferably be created in association with the cog 220 entering each of locking positions 140 by properly forming undulating surface 260. Additional or alternative forms of feedback may include motion resistance. By the interaction of tab 250 and undulating surface 260, noticeable resistance may be provided to the user of the location of each of locking positions 140 by increased resistance to linear movement between first member 110 and second member 120.

Optionally, undulating surface 260 may be formed so as not to indicate locations of each of locking positions 140, instead providing noise or physical resistance during any movement, or a predetermined amount of movement, between first member 110 and second member 120.

Figure 9:
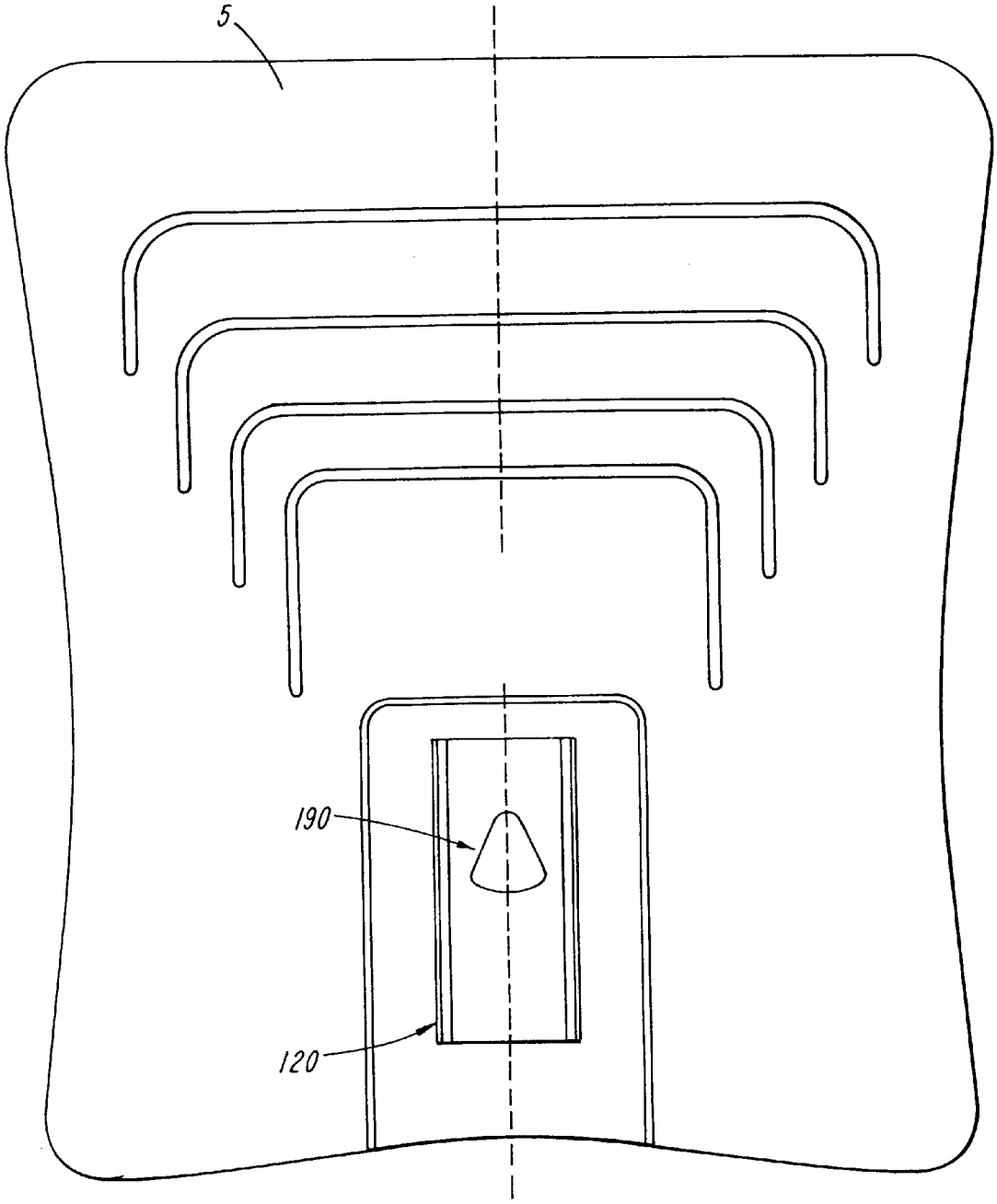
FIG. 9 is a chair backrest configured to work with an embodiment of the invention.
Figure 10:
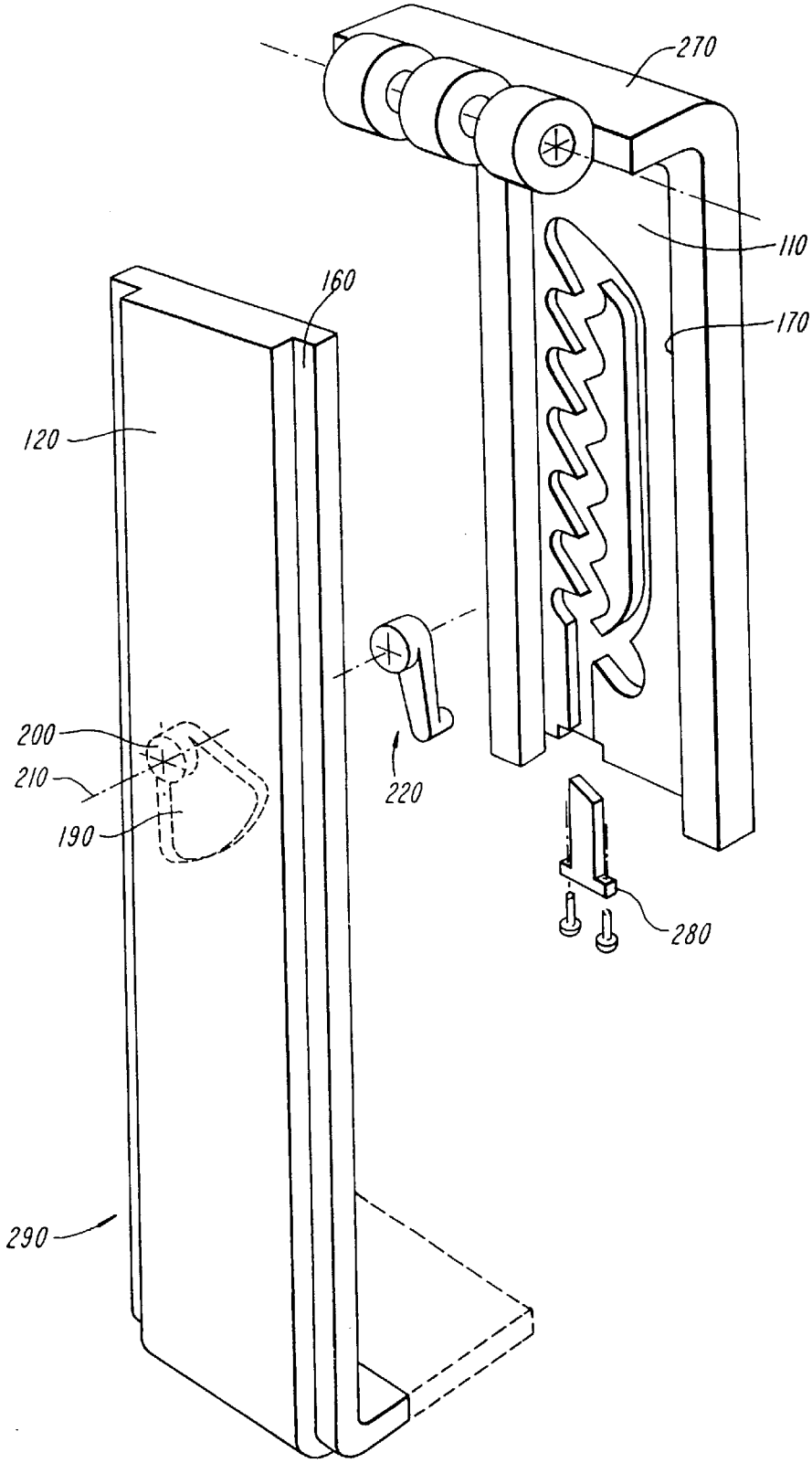
FIG. 10 is an exploded perspective view of an embodiment of the invention for use with a chair armrest.

Although various applications of the positioning mechanism 100 of the present invention are possible, several applications include furniture, such as chairs, as shown in FIGS. 9 and 10. FIG. 9 illustrates a chair backrest 5, optionally formed with an integral second member 120. Alternative variations include integrally forming a first member 110 in a chair component or providing accommodation for rapid mounting of either first member 110 or second member 120 to a chair component. By modification of the structure of chair backrest 5, a chair backrest may be optimized to provide a thin backrest and/or ideal location of cushioning by allowing positioning mechanism 100 to be located in a preferred location within chair backrest 5.

FIG. 10 illustrates an example of implementing the present invention within an application involving an armrest of a chair. Although FIG. 10 illustrates an embodiment involving an upright arm 290 formed as a second member 120 of the invention, the invention is not so limited and an upright arm 290 may alternatively be formed as a first member 110 or formed so that a separate component resembling either a first member 110 or a second member 120 may be mounted. In the configuration shown in FIG. 10, an armrest cushion is preferably attached at mounting location 270. As illustrated in FIG. 10, additional hinges or other adjustment devices may be provided at many locations.

A variation of the invention, described in relation to FIG. 10 involves forming the first member 110 as a sleeve to be placed over second member 120. In such a variation, the appearance and safety of the invention can be enhanced. Locations at which guide groove 170 and flange 160 meet would be encapsulated, hiding an elongated seam formed by the proximate locations of second member 120 and flange 160 with guide groove 170 and first member 110. Furthermore, access to portions of guide groove 170 not occupied by flange 160 would be prevented.

FIG. 10 also illustrates a variation of the embodiment shown in FIG. 2 in that first member 110 is formed with guide grooves 170, while second member 120 is formed with flanges 160.

The embodiment of the invention shown in FIG. 10 further illustrates an optional entry channel plug 280. Entry channel plug 280 is used in an alternative embodiment of the invention to preclude cog 220 from entering entry channel 240, thereby exiting channel 130, during operation. Entry channel plug 280 is preferred in locations where an entry channel as illustrated in FIG. 3 cannot be provided.

The positioning mechanism 100 of the present invention is also suitable for other applications requiring adjustable positioning of various components. By way of example, the positioning mechanism of the present invention could be used to adjust the height of a chair seat 6, illustrated in FIG. 1, or a writing surface mounted to the chair, typically found in academic settings. Further examples include lamps that are adjustable for positioning, such as a reading lamp. Other stands, such as jack stands or stands used for positioning of laboratory equipment such as magnifying glasses or lamps or electrical leads. The invention is not limited to positioning by human effort; the invention can be used in applications involving a variety of other devices proving positioning force, such as, for example, hydraulic cylinders. These examples are meant to be illustrative and not limiting. As described herein, the terms positioning mechanism and adjustment mechanism are considered to be interchangeable.

The present invention has been described by way of example, and modifications and variations of the exemplary embodiments will suggest themselves to skilled artisans in this field without departing from the spirit of the invention. Features and characteristics of the above-described embodiments may be used in combination. The preferred embodiments are merely illustrative and should not be considered restrictive in any way. The scope of the invention is to be measured by the appended claims, rather than the preceding description, and all variations and equivalents that fall within the range of the claims are intended to be embraced therein.

Having described the invention, what is claimed as new and protected by Letters Patent is:

1. A positioning mechanism, comprising a first member defining a channel, a second member, slidably mounted to said first member along an axis, a substantially non-biased cog, rotatably mounted to said second member, wherein said channel and said cog interact to inhibit motion of said second member in a first direction relative to said first member until said second member has traveled substantially in a second direction, wherein said cog is formed with a cog tooth sized to travel within said channel and wherein said cog tooth has a round cross-section of a first diameter and said channel has a width substantially equal to said first diameter.

2. A positioning mechanism, comprising a first member defining a channel, a second member, slidably mounted to said first member along an axis, a substantially non-biased cog, rotatably mounted to said second member, wherein said channel and said cog interact to inhibit motion of said second member in a first direction relative to said first member until said second member has traveled substantially in a second direction, and an entry channel continuous with said channel, to permit entry of said cog into said channel by slidable movement between said first and second members along said axis wherein said cog is inhibited from entering said entry channel from said channel.

3. A positioning mechanism as defined in claim 2, wherein at least one of said first and second members is adapted for mounting to a chair for positioning of a chair component relative to other chair components.

4. A positioning mechanism as defined in claim 2, wherein said channel is a loop to allow repeated motions of said first and second members in said first and second directions.

5. A positioning mechanism as defined in claim 2, wherein said second member defines a receptacle for locating said cog.

6. An adjustment mechanism, comprising, cog mounting means, allowing substantially bias-free rotatable motion of a cog; and channel means, forming a channel having at least one locking position and a return channel;

an entry channel formed in said channel means and contiguous with said channel wherein said cog is inhibited from entering said entry channel from said channel;

wherein said cog mounting means and said channel means are slidably mounted relative to each other; and wherein said cog interacts with said channel means to selectively inhibit relative movement between said cog mounting means and said channel means.

7. An adjustment mechanism as defined in claim 6, wherein said cog is formed with a cog tooth sized to travel in said channel.

8. An adjustment mechanism as defined in claim 6, wherein at least one of said cog mounting means and said channel means are mounted to a chair component.

9. An adjustment mechanism, comprising, a first member defining a channel, a second member mounted to said first member to be slidable with respect to said first member along an axis, a cog, substantially free of a biasing member and mounted between said first and second members and adapted to rotate with respect to said second member, wherein said channel is formed to create locking positions, enabling said cog to inhibit motion of said second member in a first direction relative to said first member, wherein said first member is molded into a chair backrest.

10. An adjustment mechanism, comprising, a first member defining a channel, a second member mounted to said first member to be slidable with respect to said first member along an axis, a cog, substantially free of a biasing member and mounted between said first and second members and adapted to rotate with respect to said second member, wherein said channel is formed to create locking positions, enabling said cog to inhibit motion of said second member in a first direction relative to said first member a guide groove formed in said second member, parallel to said axis, and a flange mounted along said first member, parallel to said axis, adapted for locating in said guide groove for ensuring relative motion between said first and second members, said flange being linear.

11. An adjustment mechanism, comprising, a first member defining a channel, a second member mounted to said first member to be slidable with respect to said first member along an axis, a cog, substantially free of a biasing member and mounted between said first and second members and adapted to rotate with respect to said second member, wherein said channel is formed to create locking positions, enabling said cog to inhibit motion of said second member in a first direction relative to said first member, an entry channel continuous with said channel, to permit entry of said cog into said channel by slidable movement between said first and second members along said axis wherein said cog is inhibited from entering said entry channel from said channel.

12. An adjustment mechanism, comprising, a first member defining a channel, a second member mounted to said first member to be slidable with respect to said first member along an axis, a cog, substantially free of a biasing member and mounted between said first and second members and adapted to rotate with respect to said second member, wherein said channel is formed to create locking positions, enabling said cog to inhibit motion of said second member in a first direction relative to said first member, wherein said second member defines a receptacle for locating said cog and wherein said receptacle includes an arc of approximately 53 degrees.

13. An adjustment mechanism, comprising, a first member defining a channel, a second member mounted to said first member to be slidable with respect to said first member along an axis, a cog, substantially free of a biasing member and mounted between said first and second members and adapted to rotate with respect to said second member, wherein said channel is formed to create locking positions, enabling said cog to inhibit motion of said second member in a first direction relative to said first member, wherein said second member is molded into a chair backrest.

14. An adjustment mechanism, comprising, a first member defining a channel, a second member mounted to said first member to be slidable with respect to said first member along an axis, a cog, substantially free of a biasing member and mounted between said first and second members and adapted to rotate with respect to said second member, wherein said channel is formed to create locking positions, enabling said cog to inhibit motion of said second member in a first direction relative to said first member, wherein said channel is a loop to allow repeated motions of said first and second members in said first and second directions.

15. An adjustment mechanism as defined in claim 14, wherein said rotation of said cog is limited with respect to said second member to coincide with said locking positions, thereby distributing a force applied by said first member to said cog to be applied to said second member by an elongated side of said cog.

16. An adjustment mechanism as defined in claim 14, wherein said cog is formed with a cog tooth, sized to travel within said channel.

17. An adjustment mechanism as defined in claim 14, wherein said first member is mounted to a chair seat, and wherein said second member is mounted to a chair backrest.

18. An adjustment mechanism as defined in claim 14, wherein said channel is formed to guide the rotation of said cog, allowing motion of said second member to a maximum limit in said first direction after traveling to a maximum limit in a second direction.

19. An adjustment mechanism as defined in claim 14, wherein said first member is made of plastic.

20. An adjustment mechanism as defined in claim 14, wherein said first member is mounted to a chair seat, and wherein said second member is mounted to an armrest.

21. An adjustment mechanism as defined in claim 14, wherein said channel defines at least six locking positions.

22. An adjustment mechanism as defined in claim 14, further comprising, an end limit mounted to one of either said first and second members, thereby preventing relative motion between said first and second members beyond a maximum limit of travel.

23. An adjustment mechanism, comprising, a first member defining a channel, a second member mounted to said first member to be slidable with respect to said first member along an axis, a cog, substantially free of a biasing member and mounted between said first and second members and adapted to rotate with respect to said second member, wherein said channel is formed to create locking positions, enabling said cog to inhibit motion of said second member in a first direction relative to said first member, an undulating surface formed in a side of one of said first and second members, facing an other of said first and second members and oriented parallel to said axis, a tab, mounted to said other of said first and second members and biased toward said one of said first and second members, adapted to travel along said undulating surface.

* * * * *